US005209092A

United States Patent [19]

Russo

[11] Patent Number: 5,209,092

[45] Date of Patent: May 11, 1993

[54] CONTINUOUS WIRE DRAWING PROCESS WITH CHEMICAL DESCALING AND POST-DIE TREATMENT AND APPARATUS

[76] Inventor: Anthony J. Russo, 950 Schweitzer Pl., North Brunswick, N.J. 08902

[21] Appl. No.: 754,461

[22] Filed: Sep. 3, 1991

[51] Int. Cl.[5] ..... B21C 9/00

[52] U.S. Cl. ..... 72/41; 72/39; 72/278; 72/286

[58] Field of Search ..... 72/39–41, 72/43, 278, 282, 286, 289; 51/18, 20, 22, 23

[56] References Cited

U.S. PATENT DOCUMENTS

| | | | |
|---|---|---|---|
| 1,338,453 | 4/1920 | Johnson | 72/43 |
| 1,470,374 | 10/1923 | Boley . | |
| 2,203,064 | 6/1940 | Schueler | 72/286 |
| 2,680,938 | 6/1954 | Peterson | 72/39 |
| 2,966,425 | 12/1960 | Fucinari | 72/40 |
| 3,354,687 | 11/1967 | Mauson . | |
| 3,413,832 | 12/1968 | Lang | 72/40 |
| 4,091,651 | 5/1978 | Rose | 72/40 |
| 4,553,416 | 11/1985 | Sudoh | 72/43 |

FOREIGN PATENT DOCUMENTS

| | | | |
|---|---|---|---|
| 163047 | 12/1981 | Japan | 72/40 |
| 119418 | 7/1983 | Japan | 72/41 |
| 34605 | 2/1987 | Japan | 72/40 |

*Primary Examiner*—Daniel C. Crane
*Attorney, Agent, or Firm*—Kenneth P. Glynn

[57] ABSTRACT

The present invention is a process for drawing and forming a bright wire of a predetermined diameter and cross-section, from stock of a greater diameter. It includes the steps of (a) chemically removing scale from said stock; (b) applying a coating of lubricant carrier to the descaled stock; (c) applying drying air to the stock with the lubricant carrier thereon; (d) applying a lubricant to the carrier-coated stock; (e) drawing the lubricated stock through one or more pressure dies to decrease the diameter of the stock down to the desired predetermined diameter, including lubricating before each die; (f) buffing the drawn stock with a plurality of buffing wheels, said buffing wheels being applied to the drawn stock at a plurality of angles to the direction of travel of the stock to produce bright wire; and, (g) coiling the resulting bright wire into coils for subsequent use. The chemical descaling may be continuous or batch and the remainder of the process is continuous. The speed of the stock is maintained by conventional drive mechanisms to feed into the process and to coil off the process at predetermined speeds. The present invention also includes the apparatus for the process.

14 Claims, 2 Drawing Sheets

CONTINUOUS WIRE DRAWING PROCESS WITH CHEMICAL DESCALING AND POST-DIE TREATMENT AND APPARATUS

BACKGROUND OF THE INVENTION

1. Field of the Invention

The present invention is directed to a bright wire draw process and apparatus. The process and apparatus include treatments of stock after pressure die drawing which include pre-die enhanced lubrication and post-die buffing. Higher speeds and more efficient production is achieved.

2. Prior Art Statement

The commerce of bright wire production has been active for decades and the end use of bright wire is very diverse. Metal hangers, nails, medical devices, axles, pins, shafts, rods, hooks, etc., are fabricated from bright wire, to name a few. The broad based market for bright wire includes carbon steel, alloy steel and stainless steel, as well as others.

Historically, metal stock, sometimes called hot rolled wire or rod, is manufactured from molten metal and subsequently reworked or sold for reworking into different sizes (and shapes) These stock rolls have been stretched or drawn into lesser diameters, for example, through pressure dies, and have been pretreated to remove scale or oxides, and have been lubricated to prevent rapid wear of the dies. Typically, pretreatment for scale removal involved the use of acid baths, and, even today, production facilities may utilize a batch type pickling process for descaling whereby cranes or hoists physically dip rolls of stock into and out of large heated vats of acid and rinse water and dryers. This descaling operation is costly due to labor needs, it requires large floor space and expensive equipment is slow, creates long down times for bath changes and may cause pollution problems such as spent acid disposal and acid evaporation.

Some of the very modern facilities for drawing bright wire utilize continuous instead of batch processes, but the wire must be traversed back and forth over pulleys in the baths to provide adequate bath and rinse times. Further, spent acid, evaporation, floor space and other problems remain even though the batch method is supplanted by continuous flow methods.

Additionally, bright wire production is achieved by the descaling, drawing and brightening of the wire product. This brightening is accomplished by control of limited or no lubrication to the wire as it passes through its final draw (smallest, last die). The friction of the die scrapes or otherwise removes any coatings and yields a bright product. While this method is acceptable industry wide, it does cause wear and frequent replacement of the final die and requires substantial power to pull the stock through the die by overcoming the intentional frictional drag.

These problems stated have not been addressed or overcome by the industry or prior art until the present invention. For example, good continuous draw technology which in many respects may be today's standard, is exemplified by the 1923 patent to Ernst Boley as U.S. Pat. No. 1,470,374. This patent describes the state of the art, except for perhaps computerized or modern speed control systems, but these are not the subject of the present invention. In the Boley method, three or four baths are utilized, including an acid bath and the problems pertaining thereto as discussed above are not eliminated.

To minimize problems of wire resting in acid baths during down time, e.g. die changes, etc., the art teaches the use of an intermediate wire collecting and feeding device as shown in U.S. Pat. No. 3,354,687 to Walter Mauson. While this patent issued more than 40 years after Boley, it confirms the continuing use of acid baths for descaling.

It is believed that the prior art does not address the problem of die wear and has not taught nor suggested the present method and apparatus.

SUMMARY OF THE PRESENT INVENTION

The present invention is directed to a process for drawing and forming a bright wire of a predetermined diameter and cross-section, from stock of a greater diameter. The process includes the steps of (a) chemically removing scale from said stock; (b) applying a coating of lubricant carrier to the descaled stock; (c) applying drying air to the stock with the lubricant carrier thereon; (d) applying a lubricant to the carrier-coated stock; (e) drawing the lubricated stock through one or more pressure dies to decrease the diameter to the desired predetermined diameter, including lubricating before each die; (f) buffing the drawn stock with a plurality of buffing wheels, said buffing wheels being applied to the drawn stock at a plurality of angles to the direction of travel of the stock to produce bright wire; and, (g) coiling the resulting bright wire into coils for subsequent use. The chemical descaling may be continuous or batch and the remainder of the process is continuous. The speed of the stock is maintained by conventional drive mechanisms to feed into the process and to coil off the process at predetermined speeds. The present invention also includes the apparatus for the process.

BRIEF DESCRIPTION OF THE DRAWINGS

The present invention is more fully understood when the description herein is taken in conjunction with the drawings appended hereto. In the drawings.

DETAILED DESCRIPTION OF THE INVENTION

The present invention involves bright wire drawing and especially to improvements both prior to the stock entering the dies and after the stock is drawn through the dies, but especially with post-die treatment.

It is an important object of the present invention to minimize pressure die wear and replacement and to provide for decreased energy and costs downstream from the draw through the dies.

Figure 1:
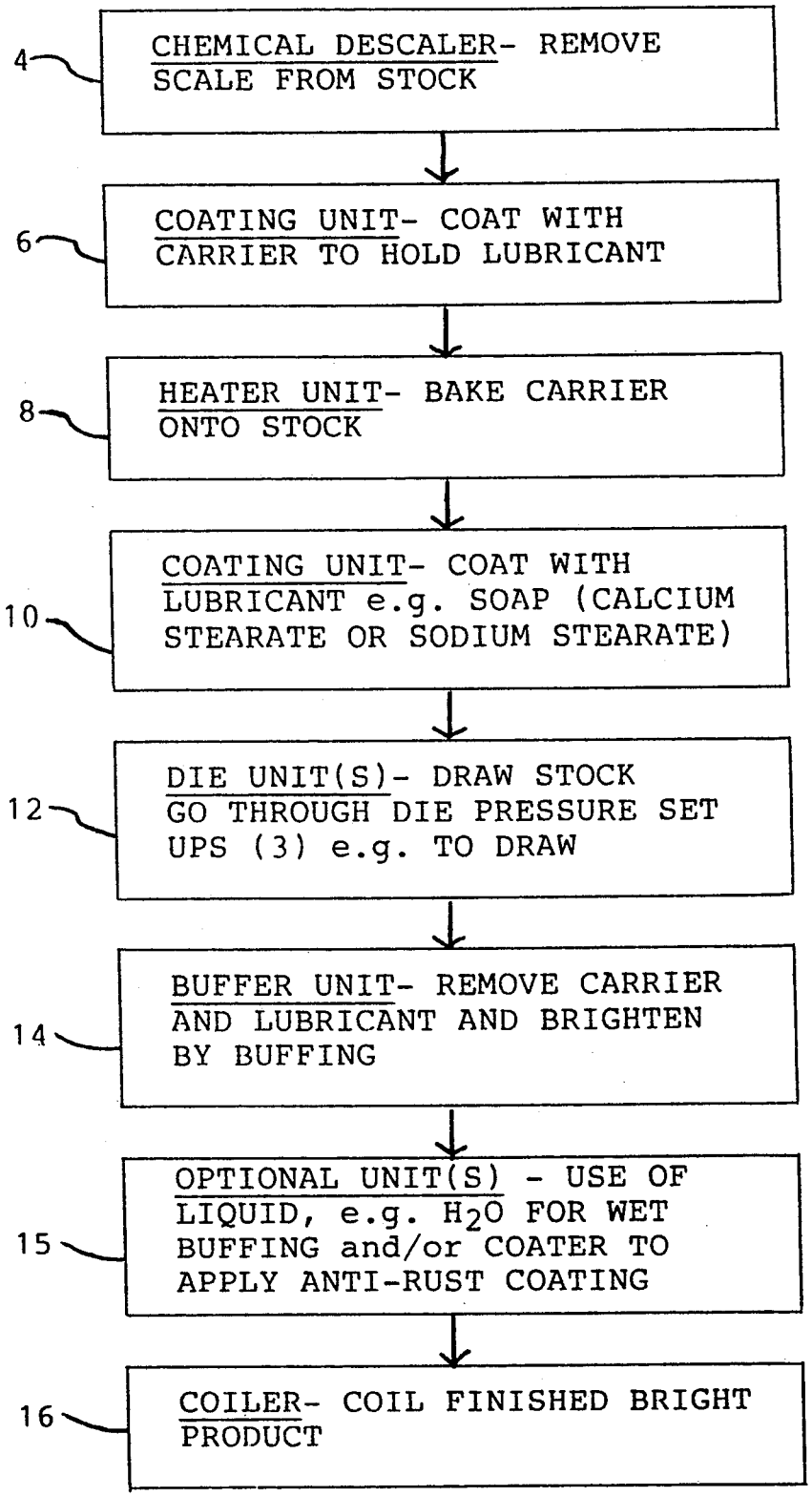
FIG. 1 shows a block diagram of the present invention process and the arrangement of units in the apparatus of the present invention; and, FIG. 2 shows a block diagram of a preferred embodiment of the present invention.

Referring now to FIG. 1, hot rolled stock, e.g. alloy steel, is first treated at chemical descaler 4. Here, the scale or metal oxide is removed chemically by the use of acid bath immersion. Generally, this chemical descaling requires adequate immersion time in an acid bath, followed by rinsing and then by neutralization (mild alkali bath). In order to maximize the effect, the stock should move in a continuous path through the baths, although frequently batch dipping is used instead and the continuous feed is used post descaling. The acid may be sulfuric acid or other acid, or mixtures. In a preferred embodiment, the rinsing is followed by drying with heaters. Whether batch or continuous feed descaling is employed, subsequent treatment is continuous.

As the stock is moved down the line by conventional motor driven systems used in pressure die drawing, the descaled stock is next coated with a lubricant carrier at coating unit 6. This is to hold lubricant on the stock for the draw through the dies. Any available lubricant carrier may be used, such as sodium borate, lye, lime or other alkali composition.

Next, the carrier is dried or "baked" onto the stock at heating unit 8 and then, at coating unit 10, the stock is coated with a lubricant, e.g. by solution flow over the moving stock or by gravity feed and/or mechanically assisted feed of powder or particulate lubricant. Such lubricants are typically soap, calcium stearate or sodium stearate or the like.

The stock moves next through one or more pressure dies having final diameters of decreasing size. Typical cross sections are circular, but other die configurations are possible and these are known in the field. In preferred embodiments, additional lubricant is applied before each die to decrease drag and increase efficiency and ease of draw.

A critical step is now applied to the drawn wire, at buffer unit 14. Here, the product is buffed with a plurality of buffers. These preferably run at diverse angles, one or more being at an angle oblique to the direction of flow of the wire. The brushes may also traverse back and forth slightly to reduce wearing one spot on the brushes. Adequate buffing is applied to remove any remaining lubricant and carrier and to enhance the brightness of the finished product. Normally, this is dry buffing. However, as shown at optional units 15, the buffing may be wet buffing (i.e., including application of a liquid, e.g. water) and/or the buffing may be followed by a coater unit to apply an anti-rust coat, e.g. an oil, to the bright wire product.

Coiler unit 16 runs continuously to coil the finished product for subsequent shipping or use.

Figure 2:
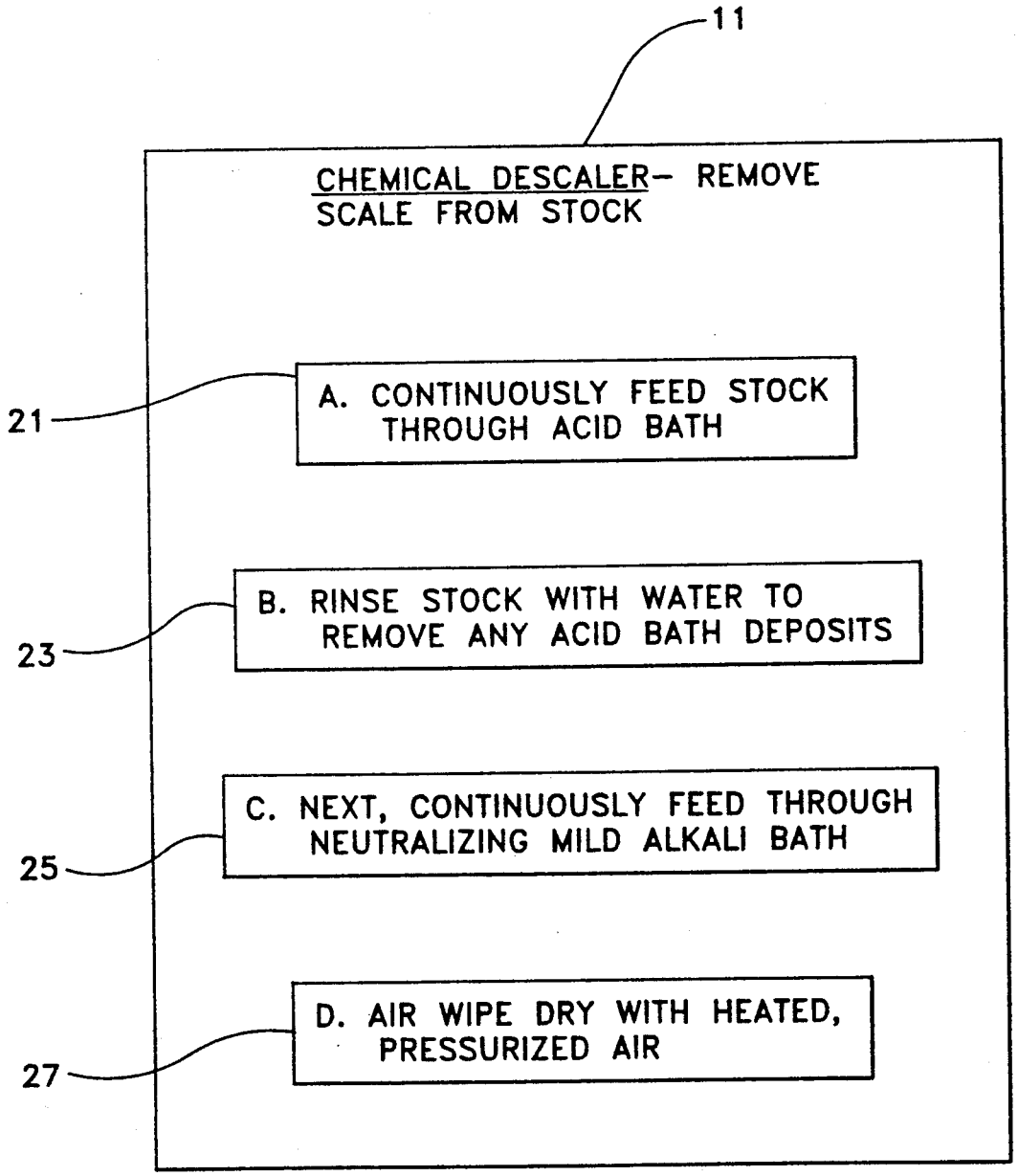

FIG. 2 shows one preferred embodiment of the present invention with respect to chemical descaling. The chemical descaler 4 of FIG. 2 is the same generically as that shown in FIG. 1 and would be included in the overall present invention process and apparatus as shown in FIG. 1. Thus, FIG. 2 depicts in block form one set of preferred substeps for the invention shown in FIG. 1. Step A, block 21, shows continuously feeding the stock through an acid bath, e.g. sulfuric acid.

Next, at block 23, step B, the stock is fed through a rinse bath to remove much of the acid and acid/scale by-products remaining.

In step C, block 25, the stock is next fed through a neutralization step, e.g. an alkali bath to neutralize any acid remaining. As shown in step D, block 27, the rinse in this embodiment is followed by a hot, pressurized air wipe to remove any water remaining after the rinse.

Referring now to both FIGS. 1 and 2, the preferred embodiment steps shown in FIG. 2 are followed by the subsequent steps shown in FIG. 1. Further, preferred embodiments include the hot buffing and the anti-rust coating steps shown as optional units 15 in FIG. 1.

Obviously, numerous modification and variations of the present invention are possible in light of the above teachings. It is therefore understood that within the scope of the appended claims, the invention may be practiced otherwise than as specifically described herein.

What is claimed is:

1. A process for drawing and forming a bright wire of a predetermined diameter and cross-section from stock of a greater diameter, which comprises:

(a) removing substantially all of the scale from the wire by only chemically removing the scale from said stock on a continuous basis which includes the following steps:
  (i) Immersion in an acid bath;
  (ii) Immersion in a water rinse bath; and,
  (iii) Immersion in a mild alkali bath;

(b) applying a coating of lubricant carrier to the chemically descaled stock;

(c) applying drying air to the stock with the lubricant carrier thereon;

(d) applying a lubricant to the dried carrier-coated stock;

(e) drawing the lubricated stock through a plurality of sequential pressure dies and each sequential die has a final diameter less than that of any die preceding it and lubricating the stock before each die to decrease the diameter to the desired predetermined diameter;

(f) buffing the drawn stock with a plurality of buffing wheels, said buffing wheels being applied to the drawn stock at a plurality of angles to the direction of travel of the stock to produce bright wire; and, (g) coiling the resulting bright wire into coils for subsequent use; wherein the speed of the stock is maintained by conventional drive mechanisms to feed into the process and to coil off the process at predetermined speeds.

2. The process of claim 1 wherein said plurality of dies are in a straight line draw sequence.

3. The process of claim 1, wherein said immersions in step (a) are followed by pressurized air wiping.

4. The process of claim 3 wherein said air is heated.

5. The process of claim 1 wherein said buffing in step (f) is a dry buffing step.

6. The process of claim 1 wherein said buffing in step (f) is a wet buffing step.

7. The process of claim 1 wherein after said buffing step (f) and prior to coiling, the stock is coated with a rust-resistant oil coating.

8. An apparatus for a continuous drawing and forming of a bright wire of a predetermined diameter and cross-section from stock of a greater diameter, which includes conventional drive mechanisms for maintaining the speed of the stock entering, passing through and exiting said apparatus, which further comprises the following units:

(a) a descaling mechanism for removing substantially all of the scale from the wire consisting of only a chemical descaler including an acid bath, a rinse bath and a neutralizing bath;

(b) a lubricant carrier feed mechanism for applying lubricant carrier to the chemically descaled stock;

(c) a heater unit for applying drying air to the stock with the lubricant carrier thereon;

(d) a plurality of lubricant feed mechanisms for applying a lubricant to the stock prior to drawing, at least one of said plurality of lubricant feed mechanisms being located before each of the plurality of pressure die units as set forth below;

(e) a plurality of pressure die units, each having a final diameter less than that of the original stock and each having a final diameter less than that of any preceding dies;

(f) a buffer mechanism including a plurality of buffers for removing any carrier and lubricant from the drawn stock and for buffing and brightening the stock; and, (g) a coiler to wind the resulting bright wire.

9. The apparatus of claim 8 wherein said chemical descaler also includes a pressurized air wiping means.

10. The apparatus of claim 8 wherein said buffer mechanism is a dry buffing means.

11. The apparatus of claim 8 wherein said buffer mechanism is a wet buffing means.

12. The apparatus of claim 8 which further includes anti-rust oil coating means located after said buffer mechanism and before said coiler.

13. The apparatus of claim 10 which further includes anti-rust coating means located after and adjacent to said dry buffing means.

14. The apparatus of claim 11 which further includes anti-rust coating means located after and adjacent to said wet buffing means.

* * * * *